US007000696B2

(12) United States Patent
Harkins

(10) Patent No.: US 7,000,696 B2
(45) **Date of Patent: *Feb. 21, 2006**

(54) METHOD AND APPARATUS FOR DETERMINING THE TEMPERATURE OF SUBTERRANEAN WELLS USING FIBER OPTIC CABLE

(75) Inventor: Gary O. Harkins, Bakersfield, CA (US)

(73) Assignee: Sensor Highway Limited, Southampton (GB)

( * ) Notice: Subject to any disclaimer, the term of this patent is extended or adjusted under 35 U.S.C. 154(b) by 163 days.

This patent is subject to a terminal disclaimer.

(21) Appl. No.: 10/249,205

(22) Filed: Mar. 21, 2003

(65) Prior Publication Data

US 2004/0040705 A1 Mar. 4, 2004

Related U.S. Application Data

(63) Continuation of application No. 10/064,891, filed on Aug. 27, 2002, now Pat. No. 6,557,630.

(60) Provisional application No. 60/315,658, filed on Aug. 29, 2001.

(51) Int. Cl.
*E21B 47/06* (2006.01)
*E21B 19/08* (2006.01)

(52) U.S. Cl. ..... 166/250.01; 166/66; 166/70; 166/77.1; 166/385

(58) Field of Classification Search ..... 166/250.01, 166/66, 70, 77.1, 385, 384, 379; 73/152.12, 73/152.18, 152.54, 866.5
See application file for complete search history.

(56) References Cited

U.S. PATENT DOCUMENTS

| | | | | |
|---|---|---|---|---|
| 5,992,250 | A * | 11/1999 | Kluth et al. | 73/866.5 |
| 6,116,578 | A * | 9/2000 | Pruett | 254/134.4 |
| 6,532,839 | B1 * | 3/2003 | Kluth et al. | 73/866.5 |
| 6,542,228 | B1 * | 4/2003 | Hartog | 356/73.1 |
| 6,547,435 | B1 * | 4/2003 | Grosswig et al. | 374/137 |
| 6,557,630 | B1 * | 5/2003 | Harkins et al. | 166/250.01 |
| 6,618,677 | B1 * | 9/2003 | Brown | 702/13 |
| 6,817,257 | B1 * | 11/2004 | Kluth et al. | 73/866.5 |

OTHER PUBLICATIONS

SENSA, Kwiklog, brochure, unknown date, 2 pages, published by SENSA, Hampshire UK.

* cited by examiner

*Primary Examiner*—Hoang Dang
(74) *Attorney, Agent, or Firm*—David B. Dickinson; Lundeen & Dickinson, LLP

(57) ABSTRACT

Methods and apparatuses to determine the temperature profile of a pressurized wellbore using a fiber optic cable and an anchor are disclosed. Furthermore, a pressurized wellhead spool that couples to a standard Christmas tree structure on a well head to facilitate the injection of fiber optic cable into an oil and gas well is disclosed. The wellhead spool is portable and may be connected to fiber optic cable already located at the site, for quick connection to on-site instrumentation. A method of using the apparatuses disclosed to measure wellbore temperature at multiple depths of investigation is also disclosed.

52 Claims, 5 Drawing Sheets

METHOD AND APPARATUS FOR DETERMINING THE TEMPERATURE OF SUBTERRANEAN WELLS USING FIBER OPTIC CABLE

CROSS REFERENCE TO RELATED APPLICATIONS

This application is a continuation application of U.S. Ser. No. 10/064,891 filed Aug. 27, 2002 now U.S. Pat. No. 6,557,630. Furthermore, this application claims the benefit of provisional application U.S. Ser. No. 60/315,658 filed Aug. 29, 2001.

BACKGROUND OF INVENTION

Oil and gas exploration is a risky, complex task that involves sophisticated equipment and substantial financial resources. Whether on land or at sea, a search for oil and gas commences with the drilling of a well. A well may reach a depth of over a mile, or, in the case of ultraheavy rigs, may reach more than six miles in depth.

Once a well is drilled, a technique known as well logging (or wireline logging) provides valuable information about the well, specifically about the likely presence of hydrocarbons nearby. Traditionally, wireline logging was performed by lowering a measuring device known as a sonde down the well. A sonde is a metal container, usually a cylinder, which contains various instrumentation used to gather data.

The wireline sonde is lowered to the bottom of the well, at the well bore. Measurements are taken by the sonde as it is being lifted back to the surface of the well. The types of measurements taken may vary widely. Examples of measurements that may be performed include natural radiation emission, reaction to gamma ray or neutron bombardment, sonic, electrical, electromagnetic induction, resistivity, and so on.

With multiple instruments contained within, the sonde is typically heavy enough to be dropped down the well on a cable or wire. The sonde may be pulled back to the surface using a wench or a pulley.

Recently, fiber optic cable has been used as an alternative for obtaining valuable well data. Fiber optic cable may be advantageous because data can be transmitted at a high speed over long distances. Fiber optic cable is non-conductive and thus may be preferable to use in the well over electrical or electromechanical instruments because of the presence of explosive hydrocarbons.

Better yet, the measurements obtained using the fiber optic cable may be immediately transmitted up the well to a receiving system, such as a portable computer. Using techniques such as optical time domain reflectometry (OTDR), fiber optic cables have, in many cases, supplanted traditional mechanisms for obtaining data within the well bore. Transmitting fiber optic cable down a well under pressure, however, may be problematic.

Thus, there is a need for a method of delivering fiber optic cable down a well under pressure.

SUMMARY OF INVENTION

In accordance with the embodiments described herein, a wellhead spool is disclosed comprising a connection to a well head, a sealed spool for storing fiber optic cable to be disposed down a well bore, and an anchor coupled to the fiber optic cable, wherein the anchor is placed in an opening of the well head and the fiber optic cable is released from the spool. In one embodiment, the wellhead spool comprises a motor, preferably hydraulic, coupled to the spool to both release the fiber optic cable from and to return the fiber optic cable to the spool. In a second embodiment, the wellhead spool comprises a solvent dispersal tube to clean the fiber optic cable upon return to the spool. In a third embodiment, the wellhead spool comprises a safety valve for equalizing the pressure between the wellhead spool and the well bore.

In another aspect of the invention, a method is disclosed comprising mounting a wellhead spool providing a fiber optic cable in a sealable housing, coupling the fiber optic cable to an anchor, engaging the sealable housing to a well head, opening a valve to the well bore, deploying the anchor and fiber optic cable into the well bore, and coupling the fiber optic cable to a measuring instrument. The method further discloses dispersing a solvent upon the fiber optic cable and engaging the anchor to a wall of the well bore.

Furthermore, in another aspect of the invention, a method and apparatus to profile the temperature of a wellbore using a fiber optic cable and an anchor is disclosed. Particularly, the apparatus and method include mounting an anchor to a fiber optic cable and deploying the combination downhole to anchor and take measurements at desired depths of investigation. More specifically, a method for measuring the temperature of a wellbore at multiple depths of investigation using a fiber optic cable and an anchor is disclosed.

DETAILED DESCRIPTION

In accordance with the embodiments described herein, a wellhead spool may be employed to facilitate the injection of fiber optic or other cable into an oil and gas well. The wellhead spool is portable and may be connected to fiber optic cable already located at the site, for quick connection to on-site instrumentation. As the fiber optic cable is spooled and unspooled, crimping of the cable and other effects known to occur when cable is wrapped around an object, is avoided The wellhead spool may be used in a well under pressure, whether on land or in sub-sea exploration operations, and may operate with a wireline anchor to gravity-feed the fiber optic cable, if needed. The wellhead spool couples to a standard Christmas tree structure for practical operation by oilfield employees.

Figure 1:
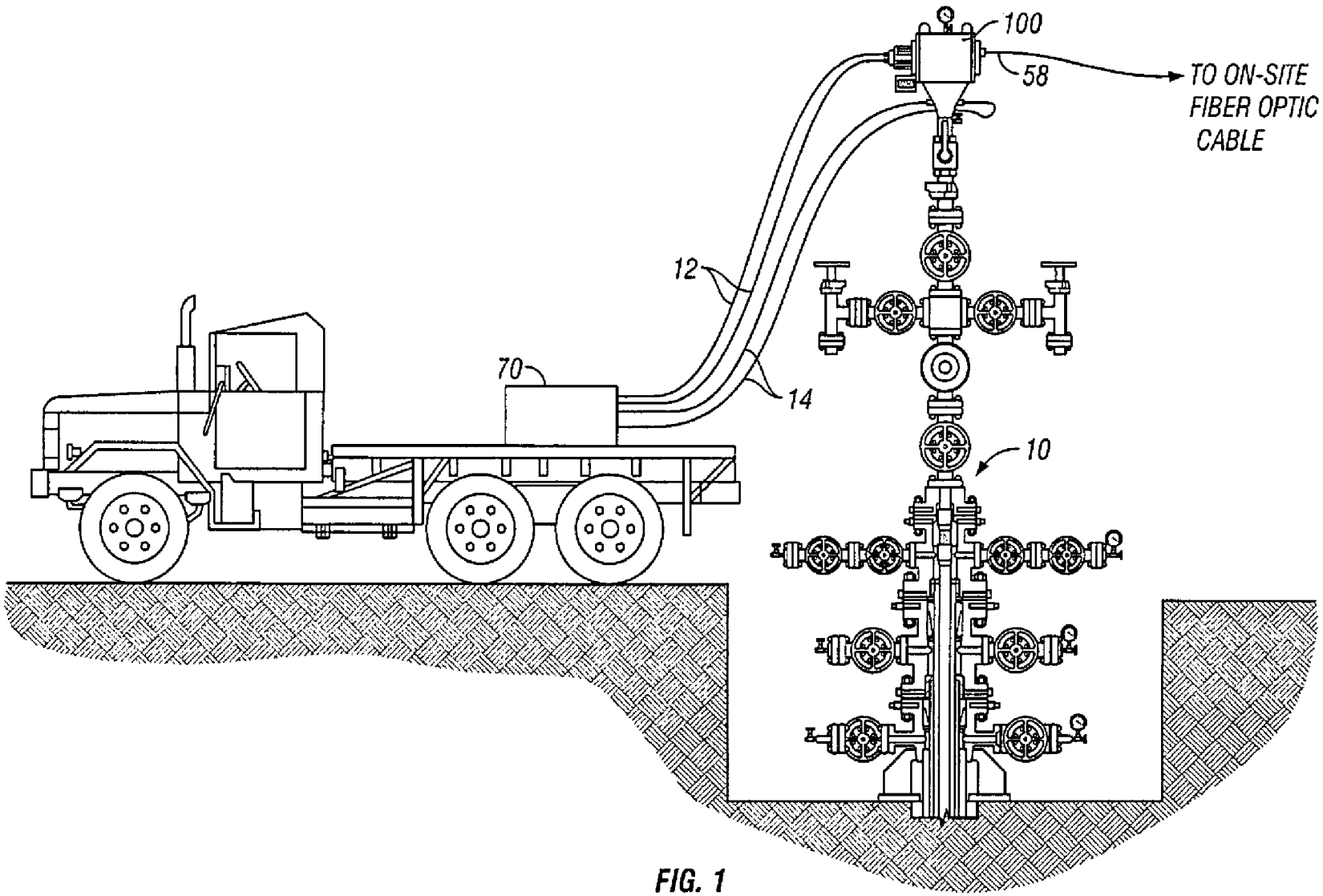
FIG. 1 is a diagram of a wellhead spool in an operative position according to a preferred embodiment of the invention.

A wellhead spool 100, coupled to a typical Christmas tree structure 10, is depicted in FIG. 1, according to one embodiment. Extending from the wellhead spool 100 are hydraulic lines 12, wash feed lines 14, and a cable feed 58. The hydraulic lines 12 and the wash feed lines 14 are coupled to a portable hydraulic pump 70 that may be situated on a vehicle, as shown. Alternatively, the lines 12 and 14 may be connected to an on-site pump, to a portable electric generator or to a different electrical power source (not shown), if available.

The cable feed 58 may be coupled to an optical time domain reflectometer (OTDR) analyzer, such as is offered by Sensa as a distributed temperature sensing (DTS) device, or to on-site fiber optic cable (not shown). The on-site fiber optic cable may already be connected to the OTDR analyzer or other instrumentation such as a laptop computer, in preparation for performing well measurements. The wellhead spool 100 conveniently provides the link between the instrumentation and the well, as described further below.

Alternatively, the wellhead spool 100 may be maintained at the site and used, as needed, to obtain well information such as temperature, resistivity, chemical characteristic of the sub-surface structure, and so on. Additional valves and/or pipes, not shown in FIG. 1, may be coupled between the wellhead spool and the remainder of the Christmas tree structure 10, as is the normal practice in well maintenance.

Figure 2:
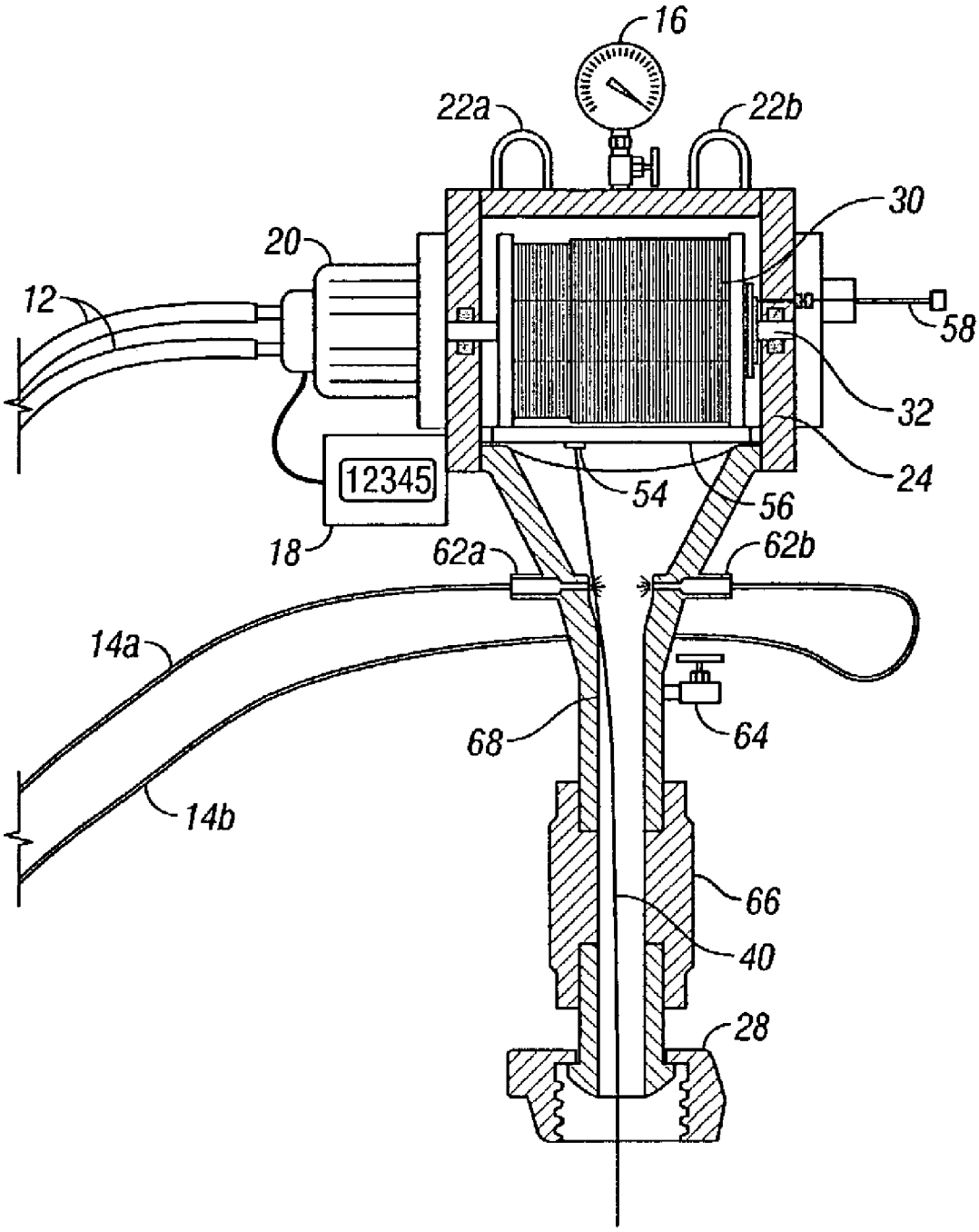
FIG. 2 is an inside view of the wellhead spool of FIG. 1 according to one embodiment of the invention.

In FIG. 2, a more detailed view of the wellhead spool is depicted, according to one embodiment. The wellhead spool 100 includes spool housing 24, inside which a spool 30 of fiber optic cable 40 is maintained. The spool 30 rotates around an axle 32 which is operated by a motor 20, which may be a hydraulic motor. The spool housing 24 further includes a spool guide 54 coupled to a spool guide track 56. The spool guide 54 moves freely along the spool guide track 56 to steer the fiber optic cable to and from the spool 30. Although depicted below the spool 30 in FIG. 2, the spool guide 54 and track 56 may be positioned above the spool, in another embodiment. The fiber optic cable 40 may be held by a centralizing apparatus such as a ring, a guide, or by other methods well-known to those of skill in the art.

The hydraulic motor 20 is coupled to the hydraulic lines 12, through which hydraulic fluid is transported. The hydraulic pump 70 (see FIG. 1) feeds the hydraulic fluid, typically an oil-based liquid, which then causes the hydraulic motor 20 to rotate, and, thus, the axle 32 and spool 30 to turn. Alternatively, an electric motor can be used to supply power to the wellhead spool 100.

In one embodiment, a counter 18 is connected to the hydraulic motor. The counter 18 may tally the number of rotations, the length of the fiber optic cable disposed, and so on. This allows oil field workers to reasonably ascertain the position of the fiber optic cable 40 as it is disposed down the well bore.

The wellhead spool 100 further includes a pressure gauge 16, disposed upon the top of the spool housing 24, in one embodiment. Upon engagement, the wellhead spool becomes part of the wellhead. Accordingly, the contents therein may be under high pressure. The pressure gauge 16 is a standard device for monitoring the physical condition of the well bore. On either side of the pressure gauge, a pair of lift eyes 22 are coupled to the spool housing 24, for handling of the spool 100.

The wellhead spool 100 is coupled to the Christmas tree 10 or other wellhead structure by a quick-connect flange 28, in one embodiment. In one embodiment, the quick-connect flange 28 is a type of threaded hammer union device, known to those of skill in the art. The quick-connect flange 28 is one of a number of devices, known to those familiar with oilfield exploration and maintenance, that may be used to connect the wellhead spool 100 to the Christmas tree 10.

Figure 3:
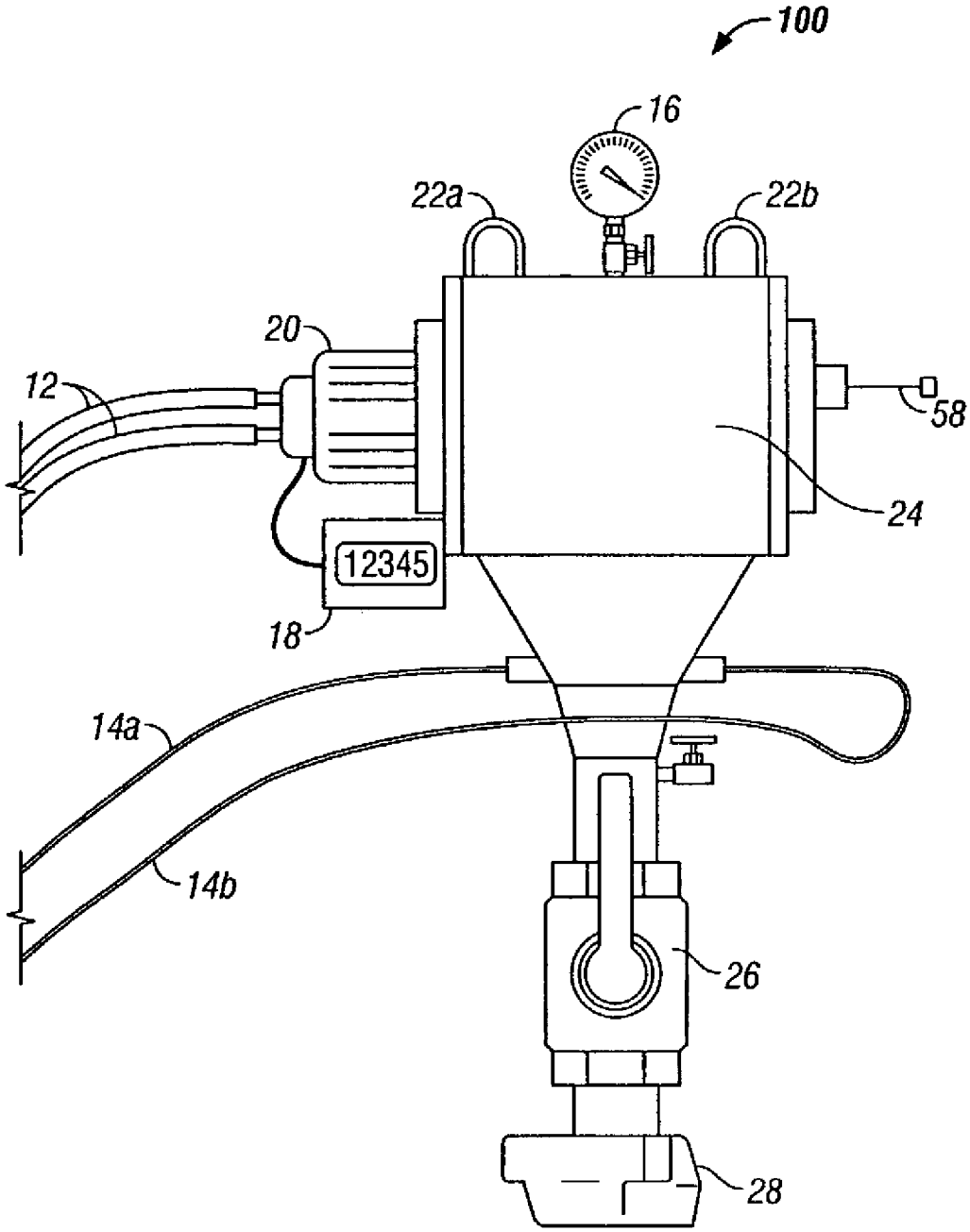
FIG. 3 is a diagram of the outside of the wellhead spool of FIG. 1 according to one embodiment of the invention.

Above the quick-connect flange 28 is a safety valve housing 66 for supporting a safety valve 26, as shown in FIG. 3. Until the safety valve 26 is opened, the fiber optic cable 40 is not sent down the wellhead. Further, in one embodiment, the safety valve 26 is used to balance the pressure from the well following installation or to prevent a high-pressure incident during removal of the wellhead spool from the well.

Extending downward in a cylindrical, then tubular arrangement, a fiber optic feed tube 68 receives the fiber optic cable 40. Upon engagement of the wellhead spool 100 with the Christmas tree 10, the fiber optic feed tube 68 forms a continuous cavity with a similar cavity in the Christmas tree 10 and, ultimately, with the well bore. The continuous cavity is the conduit through which the fiber optic cable 40 is fed down, and then back up, the well bore.

Installation of the wellhead spool 100 may occur while the well is under high pressure. The fiber optic feed tube 68 cavity fills with gas under high pressure during installation. The safety valve 26 may be adjusted to equalize the pressure between the well bore and the feed tube 68. Further, in one embodiment, a bleed valve 64 is used with safety valve 26 to adjust the pressure in the wellhead spool.

The wellhead spool 100 is installed in a manner familiar to those of ordinary skill in the art. For example, to install the wellhead spool 100, a valve in the Christmas tree 10 is closed such that hydrocarbons are not released from the top of the Christmas tree 10. Then, the wellhead spool 100 is coupled to the Christmas tree with the safety valve 26 closed, according to one embodiment. Once the wellhead spool is successfully engaged with the Christmas tree, the valve of the Christmas tree 10, then the safety valve 26, are opened, allowing hydrocarbons to flow from the well bore up to the fiber optic feed tube 68.

To remove the wellhead spool 100, in one embodiment, the safety valve 26 is first closed, separating the cavity of the wellhead spool from the well bore cavity. Also, the valve of the Christmas tree is closed, in one embodiment. Prior to removing the wellhead spool, to release pressure within the fiber optic feed tube 68, the bleed valve 64 is opened, releasing pressure from the wellhead spool. The wellhead spool may then be removed safely.

Once pressure is balanced between the spool body and the well bore, the feed tube and the well bore are maintained at the same pressure, in one embodiment. Further, there is no resistance of a type typically encountered when trying to inject a line from a low pressure orifice into a high pressure stream.

In one embodiment, the wellhead spool 100 includes a mechanism for cleaning the fiber optic cable 40 as it is being returned to the spool 30. The wash feed lines 14 that are coupled to the hydraulic pump 70 (see FIG. 1) transport solvent into the wellhead spool through a pair of solvent dispersal tubes (62). A first wash feed line 14*a* is coupled to a left solvent dispersal tube 62*a*; a second wash feed line 14*b* is coupled to a right solvent dispersal tube 62*b*, as depicted in FIGS. 2 and 3.

In FIG. 2, the left solvent dispersal tube 62*a* directs the solvent toward the fiber optic cable 40 from the left; simultaneously the right solvent dispersal tube 62*b* directs the solvent toward the fiber optic cable 40 from the right. In one embodiment, the tubes 62 are positioned just above the tubular portion, in the cylindrical portion, of the fiber optic feed tube 68. Other arrangements of the solvent dispersal tubes 62 may be made. Further, other types of solvent delivery systems may be substituted without departing from the spirit of this disclosure, many of which are well-known to those in the industry.

The solvent that is dispersed may be any of a number of well-known and readily available solvents used in the maintenance of oil field technologies. For example, trichloroethylene, isopropanol, or citrus-based solvents may be effective in cleaning the fiber optic cable 40 before it is returned to the spool 30.

Figure 4:
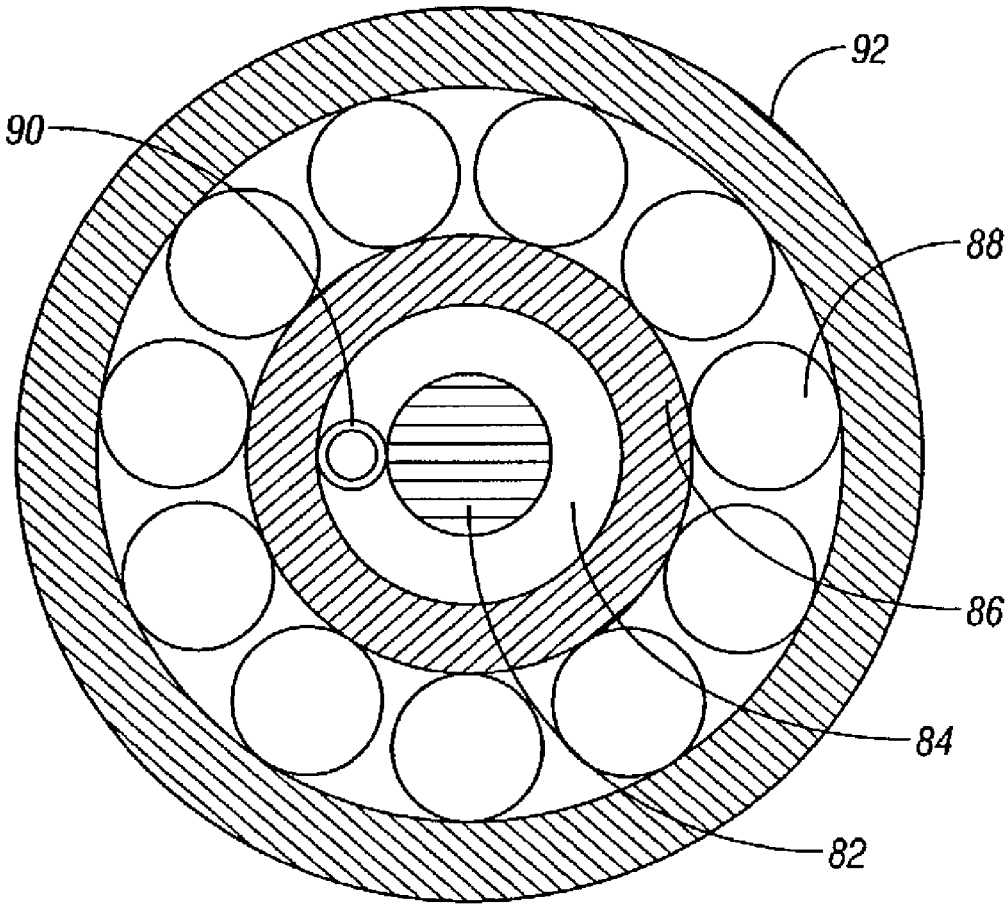
FIG. 4 is a diagram of a fiber optic cable to be disposed down a well bore according to a preferred embodiment of the invention.

The fiber optic cable 40 is depicted in FIG. 4, according to one embodiment. Central to the fiber optic cable is a bundle of fibers 82, through which light may be transported. The fibers are actually very thin strands of glass, that may be surrounded by a gel filling 84. The fiber optic cable 40 further includes tubing 86, wires 88, which are usually made of steel, and a sheath 92, giving the cable more strength.

Local data such as temperature may be measured by sending quick pulses of laser light down the fiber optic cable. A weak back-scattering of the laser light occurs, which, when measured, indicates the temperature at the point of back-scattering. In one embodiment, as the fiber optic cable 40 is disposed down the well bore, analysis of the back-scattered light spectrum is made at every meter along the fiber optic cable.

Generally, in one embodiment, pulses of light at a fixed wavelength are transmitted from the light source in surface equipment down the fiber optic line 40. At every measurement point in the line 40, light is back-scattered and returns to the surface equipment. Knowing the speed of light and the moment of arrival of the return signal, enables its point of origin along the fiber line 40 to be determined. Temperature stimulates the energy levels of the silica molecules in the fiber line 40. The back-scattered light contains upshifted and downshifted wavebands (such as the Stokes Raman and Anti-Stokes Raman portions of the back-scattered spectrum) which can be analyzed to determine the temperature at origin. In this way the temperature of each of the responding measurement points in the fiber line 40 can be calculated by the equipment, providing a complete temperature profile along the length of the fiber line 40. This general fiber optic distributed temperature system and technique is known in the prior art.

In one embodiment, part of the gel filling 84 is displaced by a gas tube 90. The gas tube allows a gas, such as nitrogen, to be transmitted through the fiber optic cable, for operating the wireline anchor 50, described in more detail, below. Although a single gas tube 90 is depicted in FIG. 4, the fiber optic cable 40 can include multiple gas tubes. With its many components and layers, the fiber optic cable is built for durability. However, in some prior art applications, the fiber optic cable may become crimped, such as when the cable is wrapped around an apparatus at an acute angle. As with a phone cord, over time, the fiber optic cable may become unwieldy in its use, as the crimping may, for example, impair the ability of the cable to be disposed down a well bore.

In some applications, therefore, the wellhead spool 100 may be preferred. The fiber optic cable 40 is unspooled from the spool and sent down the well bore in a substantially vertical direction downward. The likelihood that the fiber optic cable will become crimped is diminished, in some embodiments. Upon completion of the measurement operation, the fiber optic cable is then respooled on to the spool, where the cable is essentially stored until needed for a subsequent operation.

In prior art systems for obtaining well bore data using a sonde, the one or more instruments packed within the sonde provided some weight. Typically, the weight was sufficient such that the sonde could be disposed within the well bore using only gravity. Where the instruments were not sufficiently weighty, the sonde itself could be weighted to achieve this effect.

With fiber optic cable, however, no natural weighted element is present. Furthermore, many wells include hydrocarbons under pressure, making the insertion of fiber optic cable within problematic. Thus, according to one embodiment, a wireline anchor 50, as depicted in FIGS. 5A and 5B, may be connected to the fiber optic cable 40 before the cable is disposed down the well bore.

In one embodiment, the fiber optic cable 40, wrapped about the spool 30 of the wellhead spool 100, is extended down the fiber optic feed tube 68 and coupled to the wireline anchor 50. Accordingly, before installation, the wireline anchor 50 occupies a portion of the fiber optic feed tube 68. Then, the wireline anchor 50 is coupled to the fiber optic cable 40. Where the wireline anchor 50 is longer than the cavity (the fiber optic feed tube 68) of the wellhead spool 100, a short pipe may be inserted between the safety valve and the spool to permit the anchor to be enclosed with the fiber optic cabling prior to engagement with the Christmas tree 10.

The wireline anchor 50, therefore, is of a size sufficiently small to be disposed within the wellhead spool 100 and down the cavity of the Christmas tree 10. In one embodiment, the wireline anchor 50 is a cylindrical device composed principally of a non-corrosive metal, such as titanium. However, the anchor may be constructed of other metal, plastic, or composite materials, as the anchor typically does not stay in the well bore for an extended period of time.

Figure 5A:
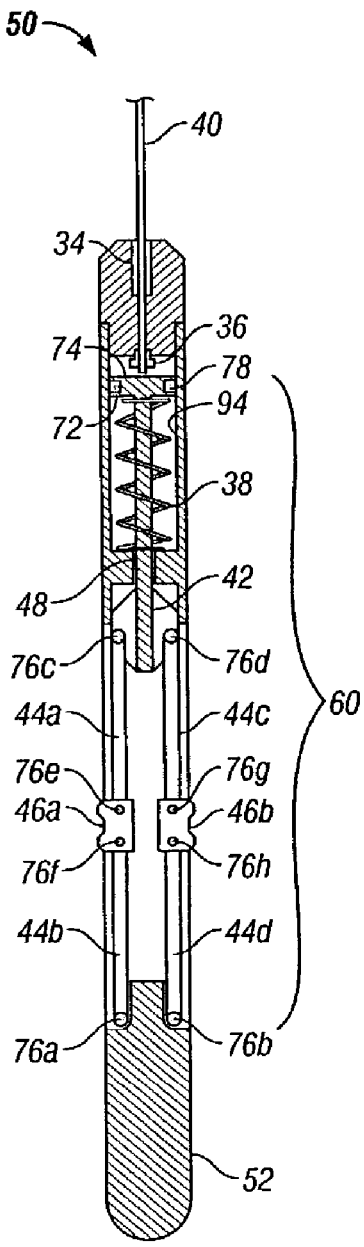
FIG. 5A is a diagram of a wireline anchor used with the wellhead spool of FIG. 1 and the fiber optic cable of FIG. 4 according to a preferred embodiment of the invention.
Figure 5B:
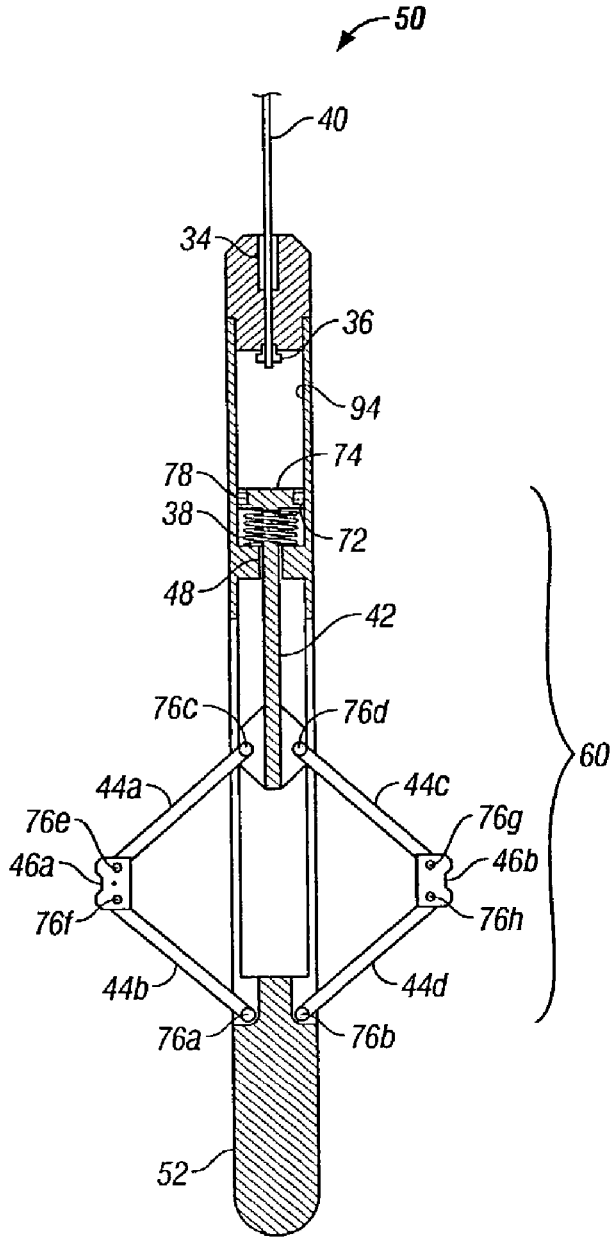
FIG. 5B is a diagram of the wireline anchor of FIG. 5A in an extended position.

In FIG. 5A, the wireline anchor 50 is shown in its retracted state. This is the state the anchor will be in as it is disposed down the well bore. In one embodiment, the wireline anchor may additionally assume an extended state, as depicted in FIG. 5B, such that the anchor may be affixed to the well wall, such as when the fiber optic cable 40 has reached the desired depth.

In one preferred embodiment, the wireline anchor 50 comprises a feed tube 34, a spring assembly 60, and a weight 52, as illustrated. The feed tube 34 receives the fiber optic cable 40. At the bottom of the feed tube is a cable connector 36. The cable connector 36 secures the fiber optic cable 40 to the wireline anchor, ensuring that the two do not separate during the trek down the well bore. The cable connector 36 may be any of a variety of securing means, such as a bolt, a clamp, or a fastener.

The spring assembly 60 comprises a spring 38, a piston 72, extension rods 44, rod housing 48, and wall engagement members, according to one embodiment. The piston 72 comprises a rod portion 42 and a head portion 74. The piston rod 42 extends through the center of the rod housing 48, parallel to the body of the wireline anchor 50. The piston head 74 is orthogonal to the piston rod 42, close to the cable connector 36.

In one embodiment, the wireline anchor 50 is cylindrical in shape. Accordingly, the piston head 74 of the anchor is a circular piece which extends a full 360 degrees along the wall of the spring assembly to allow arrangement of a dynamic sealing O-ring 78 formed in the lateral edge of the piston head. The sealing arrangement ensures that, between the cable connector 36 and the piston head 74, the cylinder bore 94 is a leak-proof cavity.

The spring 38 wraps around the piston rod 42, just below the piston head 74 and above the rod housing 48. The spring 38 is composed of a material that will allow repeated deformation and restoration of the spring 38. This allows the piston 72 to move up and down when a gas is injected into the cylinder bore 94 through the gas tube 90 (see FIG. 4) of the fiber optic cable 40.

Below the piston 72, two pairs of extension rods 44 are disposed, in parallel. A left top extension rod 44*a* is coupled to a left bottom extension rod 44*b* by a left wall engagement member 46*a*. Likewise, a right top extension rod 44*c* is coupled to a right bottom extension rod 44*d* by a right wall engagement member 46*b*, as shown.

The left and right bottom extension rods 44*b* and 44*d* are secured to a pair of hinges 76*a* and 76*b*. The hinges 76*a* and 76*b* affix the bottom of the extension rods 44*b* and 44*d* to the rod housing 48. The top of the extension rods 44*b* and 44*d* are affixed, by hinges 76*f* and 76*h*, respectively, to the wall engagement members 46.

Hinges 76*c* and 76*d* likewise affix the top of the extension rods 44*a* and 44*c* to the rod housing 48. The bottom of the extension rods 44*a* and 44*c* are affixed, by hinges 76*e* and 76*g*, respectively, to the wall engagement members 46.

The hinged connections of the extension rods 44 enable them to be mobile. When a gaseous material is injected into the wireline anchor 50 through the gas tube 90, the piston 72 moves downward until the spring 38 is maximally depressed, as shown in FIG. 5B. The extension rods 44, in turn, move such that hinges 76*c* and 76*d* move closer to hinges 76*a* and 76*b*, causing the wall engagement members 46 to move laterally. When the wireline anchor 50 is in the well bore, the gas injection causes the wall engagement members 46 to press against the wall of the well bore, according to one embodiment.

The ability to engage the wireline anchor 50 to the wall of the well bore may be useful during data gathering operations. As the wellhead spool 100 is sending the fiber optic cable 40 down the wellbore, the wireline anchor 50 may be engaged with the wall of the well bore at different points. The counter 18 may be used to keep track of approximately where in the well bore the wireline anchor is disposed.

Anchor 50 can also be activated and deactivated through other means not utilizing the gas tube 90. Particularly, in an alternative embodiment, optical energy can be sent through the fibers 82 (or another light conduit) to activate anchor 50 beneath the surface. In this configuration, anchor 50 would include a photovoltaic cell that would convert the light energy to electrical energy to extend or retract anchor 50.

Additionally, in another embodiment, at least one pressure pulse (a pressure signal with a given amplitude and duration) may be sent through the wellbore fluids from the surface, and anchor 50 may include a pressure transducer that enables and commands the extension or retraction the anchor 50 only upon recognition of a given set of pulses. In another embodiment, anchor 50 may be configured to be activated by a series of rupture discs. Using such a configuration, the wellbore fluid pressure is increased at the surface, and the discs are adapted to rupture at pre-determined pressures to activate or deactivate anchor 50. In this configuration, one rupture disc would preferably be designed to extend anchor 50 at one pressure and a second disc would be designed to rupture and retract anchor 50 at a second, elevated, pressure. As would be commonly understood by those skilled in the art, the rupture discs could be replaced by shear pins or the like.

Furthermore, collar stops, nipple profiles, muleshoes, or other mechanical landing devices may be disposed within the wellbore or production tubing to actuate anchor 50. These mechanical landing devices would also index fiber optic cable 40 and anchor 50 in desired measurement positions and activate anchor 50 mechanically with their profiles. Alternatively, a timer device may be disposed within anchor 50 to extend and retract anchor 50 at known time intervals. Using this system, an operator would position the anchor 50 on the fiber optic cable 40 at the desired measuring points during the pre-determined intervals.

Wellhead spool 100 may be deployed in sub-sea wells. The wellhead spool 100 may be installed upon the well head by divers or may be engaged using robotics, mechanical equipment, or using other means familiar to those of ordinary skill in the art. On-site fiber optic cable, that is, fiber optic cable that is connected to instrumentation at the well site, may be coupled to the wellhead spool, at the cable feed 58 (see FIG. 2), either prior to or following deployment below the surface of the water.

Finally, it is an aspect of the invention that the wellbore temperature profiling system and method is feasible without the use of a wellhead spool 100 as shown in FIGS. 1 and 2. An anchor may be disposed upon a fiber optic cable and raised and lowered into position within a wellbore to take temperature profile measurements in accordance with the present invention. It is also important to note that such temperature measurements can be made whether or not the particular wellbore in question is producing (hydrocarbons flowing) at the time of measurement.

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. A method for determining the temperature of a wellbore, the method including the steps of:

gravitationally deploying an anchor coupled to a distal end of a sensing fiber optic cable into a pressurized wellbore;

measuring temperature along at least part of the length of the sensing fiber optic cable; and retrieving the sensing fiber optic cable from the pressurized wellbore.

2. The method of claim 1, wherein the deploying step comprises:

connecting a sealable housing containing a wellhead spool onto a pressurized wellhead, said wellhead spool containing the sensing fiber optic cable spooled thereon; and unspooling the sensing fiber optic cable into the pressurized wellbore.

3. The method of claim 2, wherein the retrieving step comprises spooling the sensing fiber optic cable from the pressurized wellbore onto the wellhead spool.

4. The method of claim 3, further comprising:

connecting the sealable housing containing the wellhead spool onto a second pressurized wellhead; and unspooling the sensing fiber optic cable into the second pressurized wellbore.

5. The method of claim 1, further comprising gravitationally deploying the sensing fiber optic cable into a second pressurized wellbore.

6. The method of claim 1, wherein the measuring step comprises:

transmitting light at a fixed wavelength through a proximal end of the sensing fiber optic cable;

measuring backscatter of the transmitted light; and analyzing the backscatter to determine a temperature profile along the at least part of the length of the sensing fiber optic cable.

7. The method of claim 1, further comprising connecting a proximal end of the sensing fiber optic cable to an optical time domain reflectometer analyzer.

8. The method of claim 1 further comprising hydraulically actuating the anchor to engage the wall of the wellbore.

9. The method of claim 8, wherein the sensing fiber optic cable contains a fluid transport tube.

10. The method of claim 9 wherein hydraulic pressure is transmitted through the fluid transport tube.

11. The method of claim 3 further comprising cleaning the sensing fiber optic cable as the sensing fiber optic cable is spooled onto the wellhead spool.

12. A method for determining the temperature of a wellbore, the method comprising the steps of:

temporarily coupling an anchor to a sensing fiber optic cables;

temporarily gravitationally deploying the anchor and sensing fiber optic cable into a pressurized wellbore;

measuring temperature along at least part of the length of the sensing fiber optic cable; and retrieving the sensing fiber optic cable from the pressurized wellbore.

13. The method of claim 12, wherein the temporarily deploying step comprises unspooling the sensing fiber optic cable into the pressurized wellbore.

14. The method of claim 12, wherein the retrieving step comprises spooling the sensing fiber optic cable from the pressurized wellbore.

15. The method of claim 14, further comprising unspooling the sensing fiber optic cable into another pressurized wellbore.

16. The method of claim 12, further comprising deploying the sensing fiber optic cable into another pressurized wellbore.

17. The method of claim 12, wherein the measuring step comprises:

transmitting light at a fixed wavelength through the sensing fiber optic cable; measuring backscatter of the transmitted light; and analyzing the backscatter to determine a temperature profile along at least part of the length of the sensing optical fiber.

18. The method of claim 12, further comprising connecting the sensing fiber optic cable to an optical time domain reflectometer analyzer.

19. A system used to determine the temperature of a wellbore, the system comprising:

an anchor coupled to a distal end of a sensing fiber optic cable and adapted to be gravitationally deployed into a pressurized wellbore;

the sensing fiber optic cable adapted to measure temperature along at least part of the length of the sensing fiber optic cable; and the sensing fiber optic cable adapted to be retrieved from the pressurized wellbore.

20. The system of claim 19, wherein the sensing fiber optic cable is spooled onto a wellhead spool contained within a sealable housing; said sealable housing adapted to sealably mount onto a pressurized wellhead.

21. The system of claim 20, wherein the gravitational deployment includes unspooling the sensing fiber optic cable into the pressurized wellbore.

22. The system of claim 19, wherein the sensing fiber optic cable is deployed and retrieved into a plurality of wellbores.

23. The system of claim 19, further comprising an optical time domain reflectometer analyzer connected to a proximal end of the sensing fiber optic cable.

24. A method for determining the temperature of a wellbore, the method comprising the steps of:

mounting a wellhead spool in a sealable housing associated with a wellbore, the spool including a sensing fiber optic cable spooled thereon, said sensing fiber optic cable having an anchor attached to a distal end of the sensing fiber optic cable;

gravitationally unspooling the sensing fiber optic cable into the wellbore;

measuring temperature along at least part of the length of the sensing fiber optic cable; and spooling the sensing fiber optic cable from the pressurized wellbore.

25. The method of claim 24, further comprising the steps of:

mounting the wellhead spool in a sealable housing associated with another wellbore; and gravitationally unspooling the sensing fiber optic cable into another wellbore.

26. The method of claim 24, wherein the measuring step comprises:

transmitting light at a fixed wavelength through the sensing fiber optic cable;

measuring backscatter of the transmitted light; and analyzing the backscatter to determine a temperature profile along the at least part of the length of the sensing fiber optic cable.

27. The method of claim 24, further including connecting the sensing fiber optic cable to an optical time domain reflectometer analyzer.

28. A system to determine the temperature of a wellbore, the system comprising:

a wellhead spool mounted in a sealable housing associated with the wellbore, the spool including a sensing fiber optic cable having an anchor attached to a distal end of the sensing fiber optic cable;

the spool adapted to gravitationally unspool the sensing fiber optic cable into the wellbore;

the sensing fiber optic cable adapted to measure temperature along a length of the sensing fiber optic cable; and the spool adapted to spool the sensing fiber optic cable from the wellbore.

29. The system of claim 28, wherein:

the sealable housing is adapted to be associated with a second wellbore; and the spool is adapted to gravitationally unspool the sensing fiber optic cable into the second wellbore.

30. The system of claim 28 further comprising an optical time domain reflectometer analyzer connected to the sensing fiber optic cable.

31. The system of claim 28 wherein the wellbore is pressurized.

32. The method of claim 31 further comprising connecting the sensing fiber optic cable to an optical time domain reflectometer analyzer.

33. A method for determining the temperature of a wellbore, the method including the steps of:

gravitationally deploying a weighted assembly into a pressurized wellbore, the weighted assembly comprising a sensing fiber optic cable having an anchor coupled to the distal end of the sensing fiber optic cable;

measuring temperature along at least part of the length of the sensing fiber optic cable; and retrieving the weighted assembly from the pressurized wellbore.

34. The method of claim 33 further comprising gravitationally deploying the weighted assembly into a second pressurized wellbore.

35. The method of claim 33 wherein the measuring step comprises:

transmitting light at a fixed wavelength through the sensing fiber optic cable;

measuring backscatter of the transmitted light; and analyzing the backscatter to determine a temperature profile along the at least part of the length of the sensing fiber optic cable.

36. A system used to determine the temperature of a pressurized wellbore, the system comprising:

a weighted assembly adapted to be gravitationally deployed into the pressurized wellbore, the weighted assembly comprising a sensing fiber optic cable having an anchor coupled to the distal end of the sensing fiber optic cable;

the sensing fiber optic cable adapted to measure temperature along a length of the sensing fiber optic cable; and the weighted assembly adapted to be retrieved from the pressurized wellbore.

37. The system of claim 36, wherein the weighted assembly is adapted to be gravitationally deployed and retrieved into and from a plurality of pressurized wellbores.

38. The system of claim 36 further comprising an optical time domain reflectometer analyzer connected to the sensing fiber optic cable.

39. The system of claim 36 wherein the pressurized wellbore is producing hydrocarbons.

40. An apparatus to determine the temperature of a pressurized wellbore, the apparatus comprising:

a wellhead assembly, said wellhead assembly configured to gravitationally deploy a sensing fiber optic cable having an anchor coupled to the distal end of the sensing fiber optic cable into the pressurized wellbore;

said sensing fiber optic cable adapted to measure temperature; and said wellhead assembly configured to retrieve said sensing fiber optic cable from the pressurized wellbore.

41. The apparatus of claim 40 wherein said wellhead assembly is further configured to be deployed to a second pressurized wellbore.

42. The apparatus of claim 40 further comprising an optical time domain reflectometer analyzer connected to the sensing fiber optic cable.

43. A method to determine the temperature of a pressurized wellbore, the method comprising the steps:

communicating a wellhead assembly with the pressurized wellbore, the wellhead assembly including a sensing fiber optic cable having an anchor coupled to the distal end of the sensing fiber optic cable;

gravitationally deploying the sensing fiber optic cable into the pressurized wellbore;

measuring the temperature of the pressurized wellbore at a measurement location; and retrieving the sensing fiber optic cable from the pressurized wellbore.

44. The method of claim 43 further comprising the step of detaching the wellhead assembly from the pressurized wellbore.

45. The method of claim 44 further comprising the step of communicating the wellhead assembly with a second pressurized wellbore.

46. The method of claim 45 further comprising the steps of:

gravitationally deploying the sensing fiber optic cable into the second pressurized wellbore;

measuring the temperature of the pressurized wellbore at a second measurement location; and retrieving the sensing fiber optic cable from the second pressurized wellbore.

47. The method of claim 43 wherein the measuring step comprises:

transmitting light at a fixed wavelength through the sensing fiber optic cable;

measuring backscatter of the transmitted light; and analyzing the backscatter to determine a temperature profile at the measurement location.

48. The method of claim 43 further comprising the steps of:

deploying the sensing fiber optic cable to a second measurement location; and measuring the temperature of the pressurized wellbore at the second measurement location.

49. The method of claim 43 wherein the pressurized wellbore is producing hydrocarbons.

50. The method of claim 43 wherein the pressurized wellbore is not producing hydrocarbons.

51. A method for determining the temperature of a wellbore, the method including the steps of:

connecting a sealable housing containing a wellhead spool in communication with a pressurized wellhead, said wellhead spool having a sensing fiber optic cable, having an anchor coupled to the distal end of the sensing fiber optic cable, spooled thereon; and gravitationally inserting the anchor and sensing fiber optic cable directly into a pressurized wellbore;

measuring temperature along at least part of the length of the sensing fiber optic cable; and removing the sensing fiber optic cable from the pressurized wellbore onto the wellhead spool.

52. A system used to determine the temperature of a pressurized wellbore, the system comprising:

a hydraulically actuated anchor assembly adapted to be gravitationally deployed into the pressurized wellbore, the hydraulically actuated anchor assembly comprising an anchor attached to a distal end of a sensing fiber optic cable having a proximal and a distal end;

the sensing fiber optic cable adapted to measure temperature along a length of the sensing fiber optic cable;

said sensing fiber optic cable further comprising a fluid transport tube allowing fluid transport from the proximal end of the fiber optic cable to the distal end of the fiber optic cable; and the hydraulically actuated anchor assembly adapted to be retrieved from the pressurized wellbore.

* * * * *